United States Patent [19]

Oslin et al.

[11] Patent Number: 4,667,497

[45] **Date of Patent: * May 26, 1987**

[54] FORMING OF WORKPIECE USING FLOWABLE PARTICULATE

[75] Inventors: Brian Oslin, Long Beach; Gunes M. Ecer, Irvine, both of Calif.

[73] Assignees: Metals, Ltd.; John Virtue, both of Newport Beach, Calif. ; a part interest

[ * ] Notice: The portion of the term of this patent subsequent to Sep. 3, 2002 has been disclaimed.

[21] Appl. No.: 785,482

[22] Filed: Oct. 8, 1985

[51] Int. Cl.[4] ..... B21D 22/00

[52] U.S. Cl. ..... 72/62; 72/61; 72/364; 29/421 R

[58] Field of Search ..... 29/421 R; 72/342, 364, 72/60, 61, 62

[56] References Cited

U.S. PATENT DOCUMENTS

| | | | |
|---|---|---|---|
| 3,356,496 | 12/1967 | Hailey . | |
| 3,556,780 | 1/1971 | Holtz, Jr. . | |
| 3,561,934 | 2/1971 | Steven . | |
| 3,689,259 | 9/1972 | Hailey . | |
| 3,746,518 | 7/1973 | Holtz, Jr. . | |
| 4,111,024 | 9/1978 | Dahlman | 72/60 |
| 4,145,903 | 3/1979 | Leach | 72/60 |
| 4,227,927 | 10/1980 | Black . | |
| 4,499,048 | 2/1985 | Hanejko | 419/49 |
| 4,499,049 | 2/1985 | Hanejko | 419/49 |
| 4,501,718 | 2/1985 | Bradt | 419/49 |
| 4,518,441 | 5/1985 | Hailey . | |
| 4,539,175 | 9/1985 | Lichti et al. . | |

*Primary Examiner*—Robert L. Spruill
*Assistant Examiner*—David B. Jones
*Attorney, Agent, or Firm*—William W. Haefliger

[57] ABSTRACT

A method of forming a deformable body to desired shape includes the steps (a) providing a bed of flowable particles within a contained zone, (b) relatively positioning said particles adjacent one side of said body, (c) and pressuring said bed to cause pressure transmission via said particles to said body, thereby to deform the body into desired shape.

25 Claims, 10 Drawing Figures

100X S.E.M.

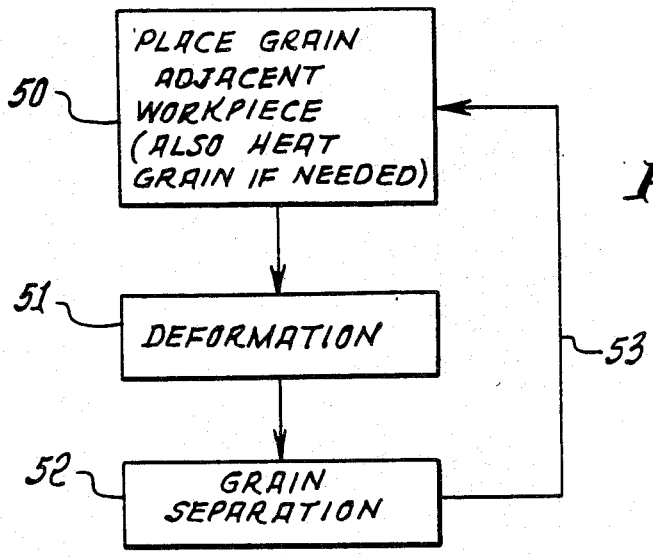
FIG. 7.
FIG. 10.
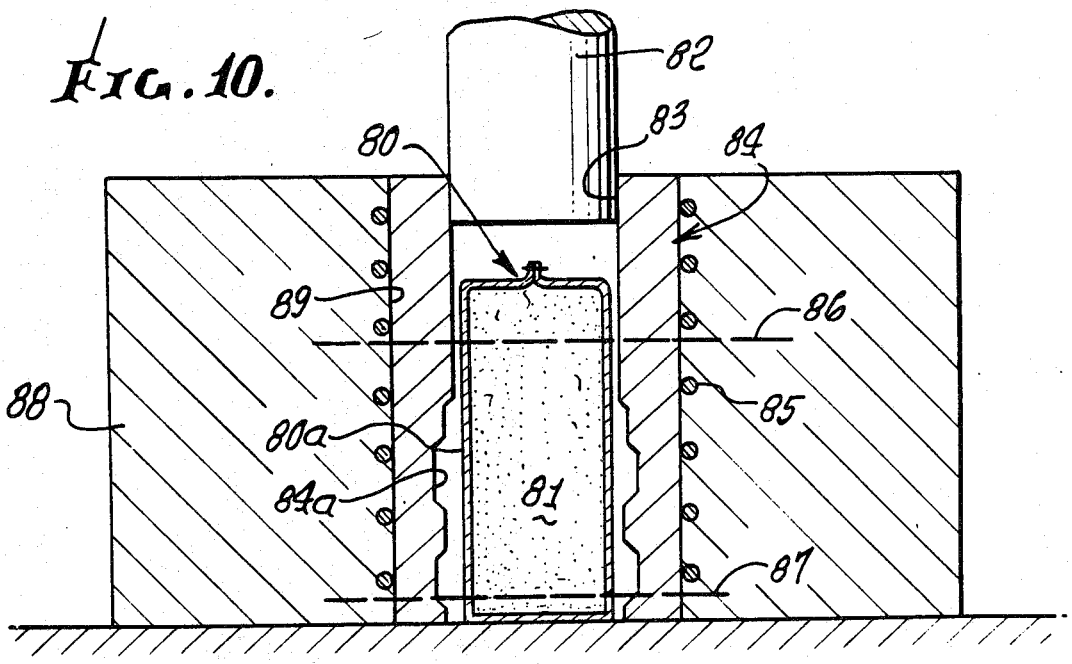

COMPRESSION STRESS/STRAIN ON VARIOUS GRAINS
3/4" ϕ DIE, NUGIER PRESS

① = 100% GRAPHITE
② = 50% CERAMIC – 50% GRAPHITE (VOLUME)
③ = 100% CERAMIC

COMPRESSION STRESS/STRAIN CURVES FOR VARIOUS CARBONACEOUS & CERAMIC GRAINS (3.375 INCH DIAMETER DIE)

① = 100% CERAMIC (3/4 INCH DIAMETER DIE)

② = 100% PETROLEUM COKE

③ = 50% CERAMIC – 50% GRAPHITE (VOLUME)

④ = 100% GRAPHITE

FORMING OF WORKPIECE USING FLOWABLE PARTICULATE

BACKGROUND OF THE INVENTION

This invention relates to the field of pressure forming or shaping of bodies, and more specifically, to an improved method which enables complex bodies to be made from a variety of materials such as metals, ceramics and plastics with minimal distortion, to near net shape, by utilization of a non-gaseous medium which transmits pressure applied by a simple press to the material being shaped.

Conventional metal forming techniques with which this invention will compete include such sheet metal forming techniques as press-brake forming, press forming, deep drawing, spinning, rubber pad forming, roll forming, stretch forming, hammer forming and explosive forming. All of these methods have found useful applications in the metals and plastics forming industries, yet, there are inherent limitations to all, as one can deduce from reading their summary descriptions in the "Metals Handbook Desk Top Edition." (1) The most important of these limitations include their inability to form non-symmetrical, closed surface (tube-like) complex shapes in most engineering alloy systems. More specifically, if an alloy system plastic deformation can only be achieved at elevated temperatures, or if the material system does not possess sufficient ductility at room temperature, most of these techniques are either useless or too cumbersome to be of practical use.

(1) American Society for Metal, ASM, Metals Park, Ohio 1985.

The present invention, on the other hand, allows not only the formation of non-symmetrical, closed surface complex shapes from nearly all metallic or plastic material systems, but it (1) American Society for Metal, ASM, Metals Park, Ohio 1985 allows bonding of one material to another while forming one or both of the materials, thereby creating a composite, a more fully finished, useful part.

The key novelty in the present invention is the use of reusable solid particulate matter as the pressure transmitting medium. None of the existing techniques utilize particulate matter as the pressurizing medium. Furthermore, the types of particulate matter, hereinafter called grain, can be selected such that the forming operation can be performed at an elevated temperature without significantly damaging the pressure transmitting characteristics of the grain, or its reusability.

SUMMARY OF THE INVENTION

It is a major object of the invention to provide the above disadvantages by deforming workpieces at ideal elevated forming temperatures, as by placing the work between a die or shaping surface and a bed of flowable particulate, usable at elevated temperature, as in a confined spaced, and to pressurize the particulate to effect deformation of the work to the shape of the die.

The method may otherwise be characterized as involving the steps:

(a) providing a bed of flowable particles within a contained zone, (b) relatively positioning said particles adjacent one side of said body, (c) and effecting pressurization of said bed to cause pressure transmission via said particles to said body, thereby to deform the body into desired shape.

Advantages of the method include:

Elimination of workhardening of some materials; reduction of costs by allowing production of more complex parts; improved manufacturing by forming at ideal temperatures; simplified material handling and storage by allowing one step production; improved accuracy; improved control of forming stresses; increased die life due to better control of stresses; increased part size formation; lowered time at temperature for parts; reduction of costs by elimination of complex punches.

Further, by use of a ceramic or graphitic grain as the pressure transfer media, psuedo-isostatic pressure transmission to all surfaces in the pressure chamber causes forming in all directions. This will form the workpiece to the desired shape with great accuracy and little springback, and also eliminate need for costly, complex punches. With the use of a ceramic or graphitic grain that can be heated to high temperatures, the workpiece can maintain its desired forming temperature throughout the forming process. This can reduce stresses, workhardening, and the detrimental effects of forming.

This invention is also applicable to forming materials that were previously extremely difficult to form, such as molybdenum, tungsten, magnesium, titanium and their alloys. Quartz and other thermo-formable ceramics, and plastics are also now easily formable.

Variations of the invention, such as the utilization of the grain inside a deformed container, or a bag to eliminate grain recharging between pressing, are also part of the invention as such variations extend the applicability of the invention.

These and other objects and advantages of the invention, as well as the details of an illustrative embodiment, will be more fully understood from the following specification and drawings in which:

DRAWING DESCRIPTION

FIG. 7 is a flow diagram;

FIG. 10 is a view like FIG. 4, showing a modification.

DETAILED DESCRIPTION

The basic method of forming a deformable body to desired, controlled shape, includes the steps;

(a) providing a bed of flowable particles within a contained zone, (b) relatively positioning said particles adjacent one side of said body, (c) and affecting pressurization of said bed to cause pressure transmission via said particles to said body, thereby to deform the body into desired shape.

Figure 1:
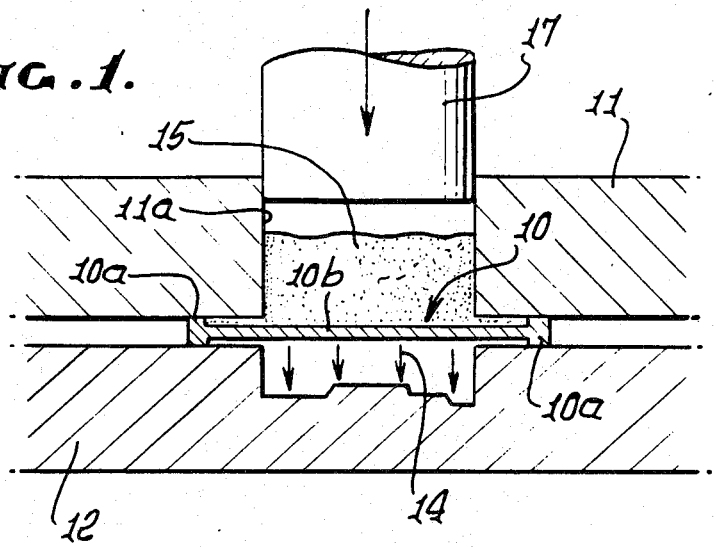
FIGS. 1–3 are elevations, taken in section, showing examples of body deformation in response to grain pressurization.

More specifically, and referring to the FIG. 1 example, the body takes the form of a metal sheet 10, and the method may include the step of gripping first portions of the sheet, as for example edges 10*a*. Such gripping may be caused by die members 11 and 12. Other portions of the sheet, as at 10*b*, are then subjected to deformation to draw or stretch same, as per direction of arrows 14.

Such deformation is affected by pressurization of grain particles in a bed 15 confined at one (upper) side of the sheet 10, as within a cavity 11*a* formed by upper die member. A punch 17 is forced downwardly in the cavity to pressurize the grain and cause the drawing of the metal sheet or workpiece. The grain may be pre-heated to selected temperature, best suited for metal sheet working or deformation, and the sheet itself may be pre-heated to that temperature. The grain remains flowable at such temperature.

Figure 2:
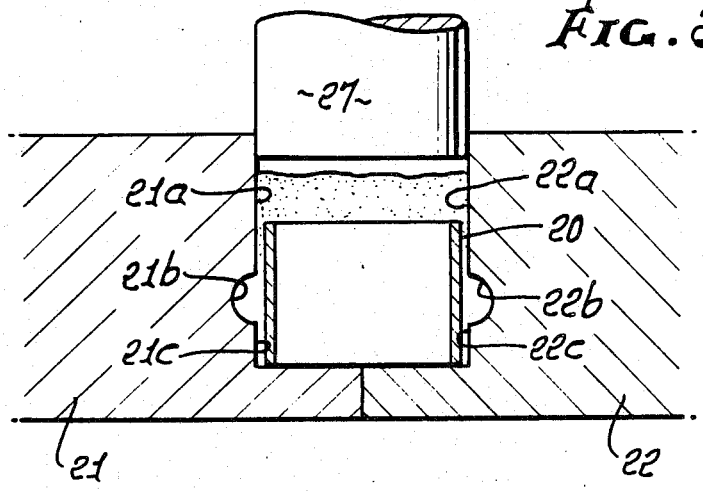

FIG. 2 shows another example in which the metal sheet 20 is tubular and annularly confined by semi-cylindrical walls 21*a*, 21*b* and 21*c* of die 21, and corresponding semi-cylindrical walls 22*a*, 22*b*, and 22*c* of right die 22. The dies interfit to form a complete cylinder at each of 21*a* and 22*a*, 21*b* and 22*b*, and 21*c* and 22*c*. Walls 21*b* and 22*b* are undercut, as shown. Grain is filled in the die recess, at the inner side of sheet 20, and above the top level thereof, inwardly of walls 21*a* and 22*a*. A punch 27 forced uniaxially downwardly into the die cavity pressurizes the grain, which, being flowable, transmits the pressure downwardly and radially outwardly to deform the sheet against walls 21*a* and 22*a*, 21*b* and 22*b*, and 21*c* and 22*c*, thereby accurately shaping the workpiece to the shapes of the die members. Thereafter, the punch is removed, and the grain removed from the cavity, and away from the formed workpiece. For this purpose, the dies 21 and 22 may be relatively separated, to allow the grain simply to drain off and away from the workpiece.

Figure 3:
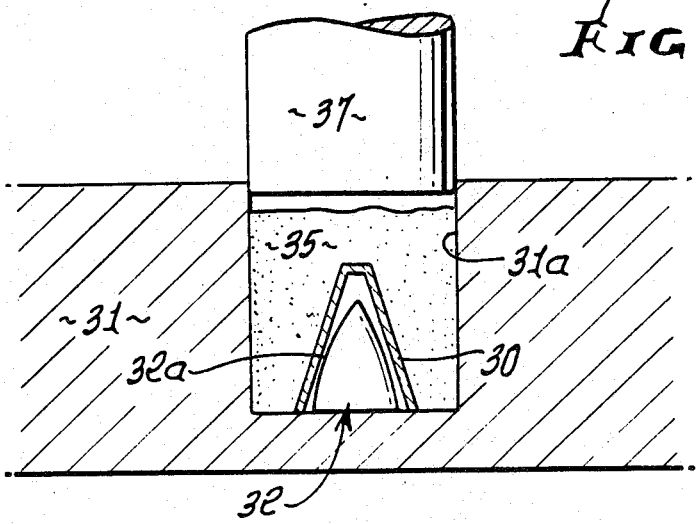

In FIG. 3, a die member 31 forms a cavity 31*a* in which a conical workpiece 30 is received over a preformed shaped surface 32*a* of die member 32. Surface 32*a* is shown as projecting upwardly into the hollow of cone 30. Grain 35 fills the cavity 31*a* at the outer side of the conical workpiece 30. When punch 37 is forced downwardly into the cavity, it pressurizes the grain, which in turn flows and exerts pressure on the workpiece, deforming it against the die surface 32*a*, to shape the work to the die surface 32*a*.

For metal (steel) objects, temperatures in the range of about 1,000° F. to 2,000° F. and uniaxial pressures of about 40 TSI are usable. Compaction at pressures of 10–60 TSI depending on the material are also within the scope of the present invention.

Figure 5:
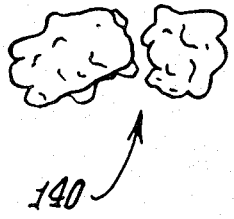
FIG. 5 is a drawing of graphite grain particles.

An unusual high degree of product dimensional stability is obtained when the bed primarily (and preferably substantially completely) consists of flowable carbonaceous particles. For best results, such particles are resiliently compressible graphite beads, and they have outward projecting nodules on and spaced apart on their generally spheroidally shaped outer surfaces, as well as surface fissures. See for example FIG. 5, showing certain particles 140 or granules as they also appear in the photographic reproduction of FIG. 6. Their preferred size is between 50 and 240 mesh. Useful granules are further identified as desulphurized petroleum coke. Such carbon or graphite particles have the following additional advantages in the process:

(1) They form easily around corners and edges, to distribute applied pressure essentially uniformly to and over the body being compacted. The particles suffer very minimal fracture, under compaction pressure.

(1a) The particles are not abrasive, therefore reduced scoring and wear of the die is achieved.

(2) They are elastically deformable, i.e. resiliently compressible under pressure and at elevated temperature, the particles being stable and usable up to 4,000° F.; it is found that the granules, accordingly, tend to separate easily from (i.e. do not adhere to) the body surface when the body is removed from the bed following compaction.

(3) The granules do not agglomerate, i.e. cling to one another, as a result of the body deformation process. Accordingly, the particles are readily recycled, for re-use, as at 53 in FIG. 7.

(4) The graphite particles become rapidly heated in response to AC induction heating, whereby the FIG. 7 step 50 may include or consist of such induction heating. The particles are stable and usable at elevated temperatures up to 4,000° F. Even though graphite oxidizes in air at temperatures over 800° F., short exposures as during cool-down, do not harm the graphite particles.

(5) The use of the graphite particle bed enables significant reduction (up to 40%) in deformation force application, as via piston 17 in FIG. 1, whereby the necessary size of the deformation equipment may be reduced.

(6) By the use of graphite bed particulate, the need for further machining and/or re-designing of the workpiece is substantially eliminated.

(7) The grain may be heated to the same or slightly higher temperature as the work, and acts as a thermal insulating barrier maintaining the preform temperature at the desired level. Also, the work is protected from oxidation by being adjacent the carbonaceous grain.

Figure 8:
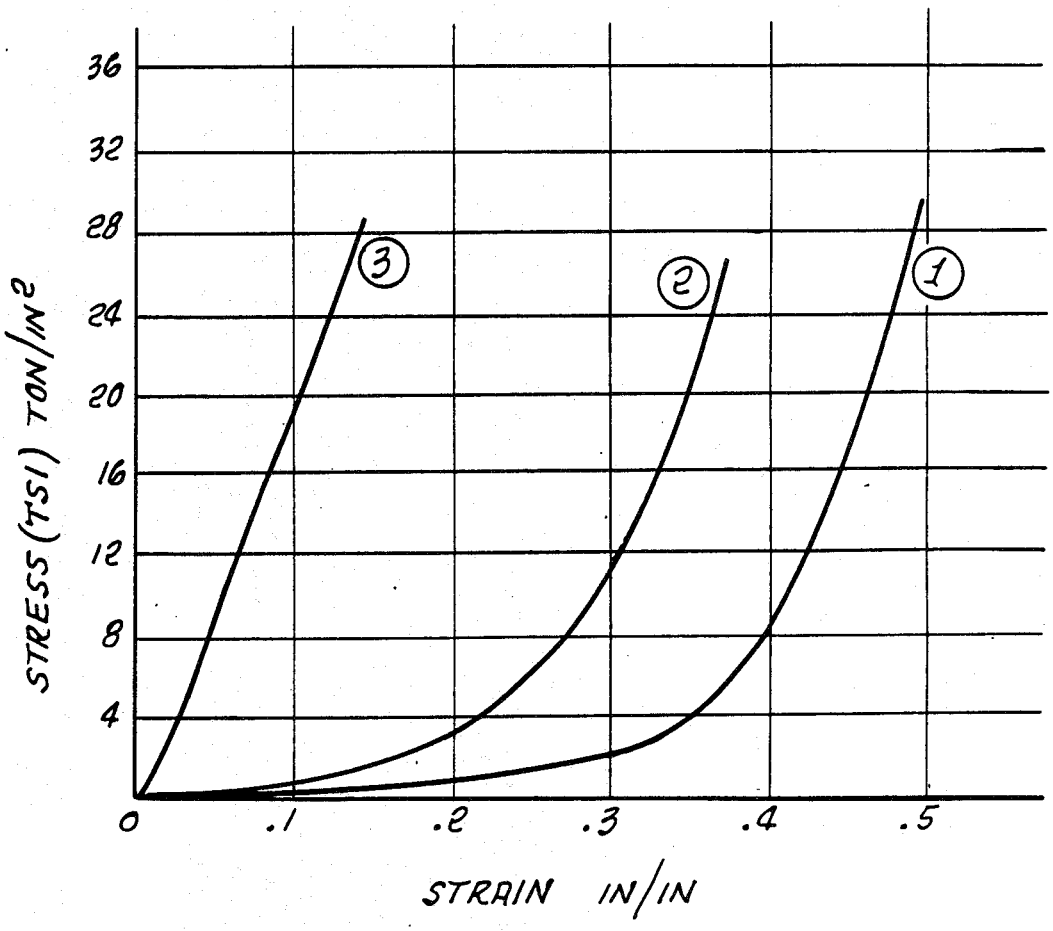
FIG. 8 is a stress-strain diagram.

FIG. 8 depicts stress-strain curves for different volume percentages of mixed graphite particles and bauxite ceramic particles, in a bed. It will be noted that for a given applied stress, the strain (compressibility) of the bed increases with an increased percentage of graphite particles, and is greatest for an all graphite bed. Mixtures of graphite particles and other carbonaceous or ceramic particles allow a tailoring of the characteristics of shape control on a body being deformed.

Figure 6:
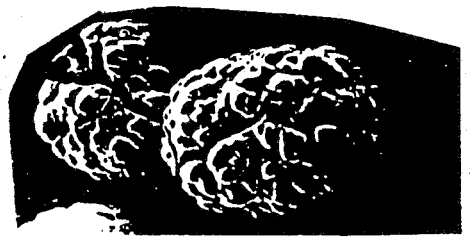
FIG. 6 is a photographic enlargement of graphite bed particles.

In FIG. 6 the graphite granules are enlarged 100 times. Note also the fissures in many particles, which contribute to compressibility.

It is also possible to employ a minor portion, by volume, of ceramic particles admixed with the carbonaceous particles in the bed 22. Such ceramic particles typically are within the size range 50–240 mesh, and may for example consist of bauxite.

For most metallic materials, deformation pressures are from 20 to 60 tons per square inch. After deformation (see 51 in FIG. 7) the work can be readily separated as at 52 from the carbonaceous grain, which is recycled hot, as indicated at 53 to conserve energy. Only a very small amount of grain, about one or two particle layers thick, remains on the formed object, and this is readily removed by any conventional cleaning method sucy as grit blasting, abrasive tumbling, brushing, etc. The workpiece may be left in the grain to cool to a temperature low enough that oxidation will be minimized.

Figure 9:
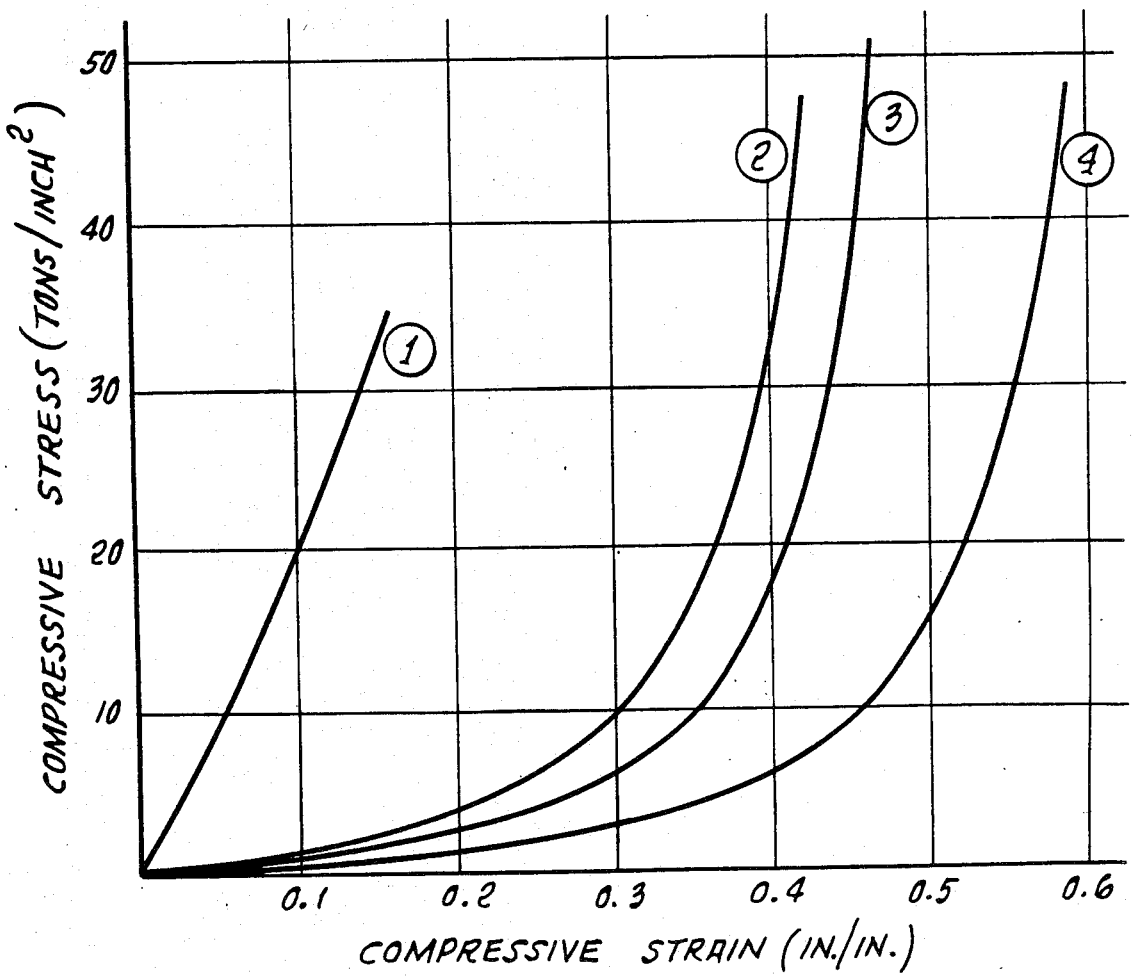
FIG. 9 is a stress-strain diagram.

The use of substantially spherical carbonaceous grain particles (not graphitic) results in the production of an unusually high degree of product dimensional stability which offers an improvement over grahitic particulate material. The compressive stress-strain curves exhibited in FIG. 9 provide the reason for this behavior. Graphitic particulates, curve (4), exhibit substantially more strain or compressibility than do the carbon particulate, curve (2). Both are bead like and both have very similar shapes and appearance; i.e. both exhibit spherically shaped nodules on the surface and surface fissures, although the graphitic particulate exhibits more of both features. The ceramic particulate has much less compressibility than both of the above as is indicated in curve (1). This is due to the fact that it bridges and consolidates and is not very elastic. Likewise, the ceramic grain would require larger stresses (pressures) to achieve a given level of densification. The carbon particulate would require intermediate pressures 10 to 20% higher than the graphitic particulate.

In attempts to develop intermediate strains in previous grains, mixtures of ceramic and graphitic grains were blended together as indicated in curve (3) FIG. 9. Heating and mixing of these intermediate strain mixtures are however very difficult due to the differences in specific gravity of the grain particles. That is, the blended mixture would separate during fluidized heating with the lighter graphitic grain rising to the surfare. Heating of the mixture without fluidization is required, but recycling and reclaiming is still a difficult problem. The carbon grain represented by curve (2) and utilized in the present invention solves both of these problems.

Additional features of this material include low cost thermal stability to 4,000° F., structural stability to pressures up to 240 ksi, non-bonding recycable nature, low friction, and excellent flowability.

Figure 4:
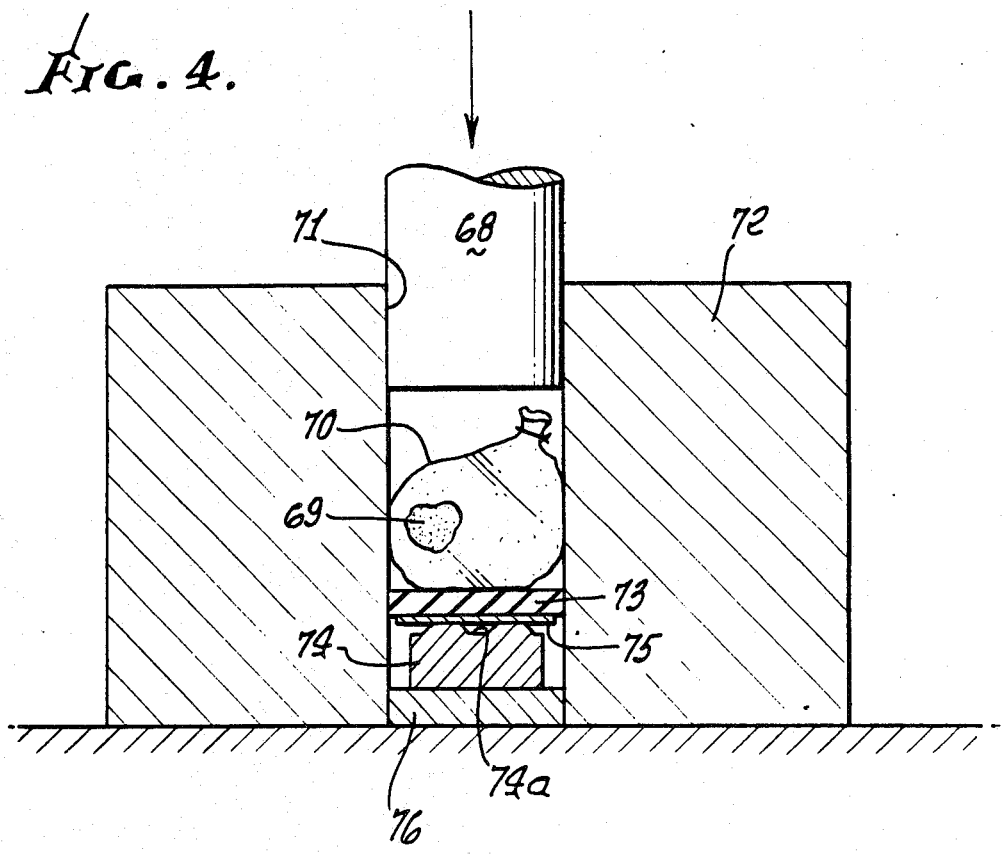
FIG. 4 is a drawing, taken in section, showing the use of grain in a container to affect forming of a sheet material.

In FIG. 4, flowable particles 69 as referred to are provided in a flexible container such as a plastic film container or bag 70. A plunger 68 transmits pressure in a bore 71 of a ring 72 to the container, pressing it and the particles against an elastomeric pad 73 in bore 71. The latter pressurizes sheet metal body 75 against forming surface 74*a* of die 74, also in bore 71. A backer for the die is shown at 76. All elements are easily removed from bore 71, after forming of sheet 72.

Now, consider a variation of the invention where the sheet material to be formed is first fabricated as a closed container 80 to hold the flowable grain 81 as shown in FIG. 10. The pressure applied to the container as by a plunger 82 in bore 83 is transmitted radially by the grain, pressing the container or capsule side surfaces 82*a* against the shaped surface 84*a* of forming die 84 which may be heated (see heater coils 85 for example). Thus, the side walls of the container will take the desired shape. The top and bottom of the deformed container may be trimmed as at planes 86 and 87 to leave the desired middle section. Pressure ring 88 receives the forming die in a recess 89.

The pressure transmitting medium utilized, in FIGS. 4 and 10, may consist for example of flowable solid particles, as discussed above, or other materials with flowable characteristics at the forming temperature. For example, the medium may be a solid liquid mixture wherein the liquid can be solid at room temperature but liquid at the forming temperature, i.e., graphite particles mixed with copper particles where the latter is liquid above 1,080° C. The medium may also be 100% liquid at the forming temperatures. Thus various mixtures of salts, such as chlorides of potassium, sodium, barium and carbonates and cyanides of the same elements, can be used at temperatures above their melting points (500° C. and up). Oils, water, and other liquids may also be used, if precautions are taken to prevent their oxidation or combustion. When the pressurizing medium is partly or 100% liquid under pressure, pressurization is isostatic, creating an equal pressure in all directions.

The invention further provides:

(a) New ways of forming metal, plastic, quartz or any material that can be formed using pressure and specific temperatures.

(b) A way of forming these materials at any ideal temperature using psuedo-isostatic pressure.

(c) A method of forming deep undercuts and recesses with much reduced tooling costs and complexity.

(d) A method of forming material with minimum stresses and workhardening.

(e) A method of laminating materials to improve performance.

(f) A method of forming materials with greater control of accuracy.

I claim:

1. The method of forming a deformable pre-heated body to desired shape, that includes the steps:

(a) providing a bed of flowable pre-heated particles within a contained zone, said pre-heatsd particles of the bed primarily consisting of resiliently compressible carbonaceous particles, there also being ceramic particles in the bed, (b) relatively positioning said particles adjacent one side of said body, said particles pre-heated to a temperature or temperatures characterized in that particles provide a thermal insulating barrier acting to maintain the body side at desired high temperature for deformation, and to resist oxidation of the body, (c) and pressuring said bed to resiliently compress said carbonaceous particles and to cause pressure transmission via said particles to said body, thereby to deform the body into desired shape,

2. The method of claim 1 further comprising the step of providing said carbonaceous particles in the form of resiliently compressible beads.

3. The method of claim 1 further comprising the step of providing said carbonaceous particles in the form of beads.

4. The method of claim 1 further comprising the step of providing said particles to have low coefficients of friction.

5. The method of claim 1 further comprising the step of providing said carbonaceous particles in generally spheroidal and graphitic form.

6. The method of claim 1 wherein said body in said bed, prior to said compaction, is at a temperature between about 1,000° F. and 4,000° F.

7. The method of claim 1 further comprising the step of providing said body in the form of a metallic sheet.

8. The method of one of claim 1–4 6 and 7 further comprising the step of providing said bed in the form of essentially all graphite particles.

9. The method of claim 1 further comprising the step of locating said body adjacent and deformed toward a carrier during said pressurization of said bed.

10. The method of claim 1 wherein said body consists of a metal sheet, and including the step of providing a die having predetermined surface shape against which said sheet is forced in response to said bed pressurization.

11. The method of claim 10 wherein at least a part of said metal sheet undergoes stretching when forced against said die surface.

12. The method of claim 10 wherein at least a part of said metal sheet undergoes shrink deformation when forced against said die surface.

13. The method of claim 1 wherein the body consists of a metal sheet, and including the steps of gripping first portions of the sheet at first locations, other portions of the sheet being subjected to said deformation to draw same relative to said locations.

14. The method of claim 1 further comprising providing the particle mesh size between 50 and 240.

15. The method of claim 1 further comprising providing the particles in the form of ceramic particles admixed with said carbonaceous particles.

16. The method of claim 15 further comprising the step of providing substantially all of said particles to have a mesh size between 50 and 240.

17. The method of claim 1 further comprising the step of providing said particles confined in a flexible container, and transmitting pressure to said container and to said particles therein, deforming said conatainer.

18. The method of claim 17 including locating an elastomeric pad between said container and said body, and transmitting said pressure via said container and particles and via said pad, to said body.

19. The method of claim 18 including locating a forming die adjacent said body and against which the body is urged to form same.

20. The method of one of claims 17–19, further comprising the step of providing said body in the form of a deformable metal sheet.

21. The method of one of claims 17–19 including providing a ring having a recess therein, and locating said container and body in said recess, and displacing a plunger in said recess to cause said pressurizing.

22. The method of claim 1 wherein said body has capsule shape and said particles are within the capsule, and including locating said capsule within a forming die against which the capsule is urged in response to said pressurization.

23. The method of claim 22 including providing a die support ring, and locating the die within said ring.

24. The method of claim 22 including providing a plunger and displacing the plunger to pressurize the capsule and said particles therein.

25. The method of one of claims 17 and 22 wherein said particles are selected from the group consisting of (i) ceramic particles
(ii) carbonaceous particles
(iii) graphitic particles
(iv) flowable metallic particles mixed with particles of one of (i), (ii), and (iii) above
(v) salts
(vi) mixtures of at least two of (i), (ii), (iii), and (iv) above.

* * * * *